United States Patent [19]

Morii et al.

[11] Patent Number: 5,027,880

[45] Date of Patent: Jul. 2, 1991

[54] TUNDISH CHANGING APPARATUS IN A CONTINUOUS CASTING INSTALLATION

[75] Inventors: Kiyoshi Morii, Konan; Shuzo Kumura, Aichi; Shizunori Hayakawa, Tokai; Yoshio Inagaki, Aichi; Tatsuo Tagawa, Nishinomiya; Ichizo Taguchi, Sakai; Takao Inoue, Nara, all of Japan

[73] Assignee: Daido Tokushuko Kabushiki Kaisha and Hitachi Zosen Corporation, Japan

[21] Appl. No.: 631,242

[22] Filed: Dec. 20, 1990

[30] Foreign Application Priority Data

Jan. 17, 1990 [JP] Japan ..... 2-3261[U]

[51] Int. Cl.[5] ..... B22D 11/10; B22D 41/00

[52] U.S. Cl. ..... 164/438; 266/143

[58] Field of Search ..... 164/437, 438, 412, 335, 164/337; 266/143, 276; 222/591

[56] References Cited

U.S. PATENT DOCUMENTS

| | | | |
|---|---|---|---|
| 3,273,208 | 9/1966 | Greenberger | 164/438 X |
| 3,446,269 | 5/1969 | Buschmann et al. | 164/438 |
| 3,782,447 | 1/1974 | Willim et al. | 164/438 X |
| 4,632,173 | 12/1986 | Kaneko et al. | 164/438 X |

*Primary Examiner*—J. Reed Batten, Jr.

*Attorney, Agent, or Firm*—Barnes, Kisselle, Raisch, Choate, Whittemore & Hulbert

[57] ABSTRACT

Two tundish transport trucks move in alternate relation between a pouring position and a tundish preheating position. A swivel table is disposed at the forward end of a transport rail which extends laterally from the pouring station for guiding the tundish transport truck for movement thereon. Provided on the swivel table are a pair of swivel rails such that one of the rails is connected to the travel rail and the other is positioned in corresponding relation to a tundish preheating device. When the swivel table turns with the tundish transport trucks mounted on corresponding swivel rails, a preheated tundish is delivered to the pouring position and a used tundish is subjected to repair and preheating so as to be ready for a next tundish changing operation.

2 Claims, 2 Drawing Sheets

TUNDISH CHANGING APPARATUS IN A CONTINUOUS CASTING INSTALLATION

FIELD OF THE INVENTION

This invention relates to a tundish changing apparatus in a continuous casting operation.

BACKGROUND OF THE INVENTION

In a continuous casting installation, molten metal collected into a ladle is first placed in a tundish and, in turn, supplied in predetermined quantities to a mold for continuous casting. The tundish, after each time of use, is subjected to repairs, such as renewal of lining, and then preheated for use in a next cycle of pouring operation. Therefore, two tundishes are alternately employed for one continuous casting machine.

Conventionally, an apparatus employed for tundish changing purposes includes a transport rail extending laterally from a pouring position, and a shift rail placed at the end of the transport rail which extends in a direction perpendicular to the transport rail. A shift truck movable reciprocally along the shift rail is mounted on the shift rail. Placed on the shift truck are a pair of mounting rails adapted to be selectively connected to the transport rail upon movement of the shift truck. Preheating devices are disposed at opposite ends of the shift rail so that when one of the mounting rails is connected to the transport rail, the other mounting rail is located at the position of one of the preheating devices. The two tundishes are respectively mounted on the tundish transport trucks.

When one of the tundish transport trucks is at the pouring position, the shift truck shifts so that one of the mounting rails is connected to the transport truck to enable the one tundish transport truck to be mounted thereon. In this case, the other tundish transport truck is mounted on the other mounting rail, and the other tundish on this truck is preheated by one of the preheating devices.

Upon completion of the pouring operation, the one tundish transport truck is transferred onto the one mounting rail via the transport rail. Then, the shift truck moves so as to enable the other tundish transport truck to be transferred onto the transport rail. Conversely, the tundish on the one tundish transport truck is preheated by the other preheating device.

One drawback of such prior art arrangement is that a large bed space is required for reciprocal movement of the shift truck. Another drawback is that two preheating devices are required because of the presence of two preheating positions for one continuous casting machine.

SUMMARY OF THE INVENTION

The invention is directed to overcoming the foregoing problems, and accordingly it is a primary object of the invention is to provide a tundish changing apparatus in a continuous casting installation which requires less bed space, has one preheating unit only, and permits cost saving.

In order to accomplish this object, according to the invention there is provided a tundish changing apparatus in a continuous casting installation including two tundish transport trucks each having a tundish mounted thereon and reciprocally movable between a pouring position and a preheating position, comprising:

a transport rail extending laterally from the pouring position for guiding said tundish transport trucks for movement thereon, a swivel table pivotally movably disposed at the end of said transport rail, a pair of swivel rails arranged on the swivel table at symmetrical positions relative to the center of swivel movement of the table and so adapted that one of said swivel rails is selectively positioned for connection to the transport rail as the table swivels, and a tundish preheating device disposed at a position corresponding to the other of said swivel rails when the one swivel rail is positioned for connection to the transport rail.

According to such arrangement, one of the tundishes is preheated by the preheating device at the preheating position on the swivel table and allowed to stand ready for operation. Upon completion of a pouring operation by the other tundish, the tundish transport truck on which the other tundish is mounted is moved from the pouring position along the transport rail and swivel rail so that it is mounted on the swivel table. The swivel table is turned 180° while being loaded with the two tundish transport trucks, and one of the swivel rails on which is carried the one transport truck loaded with the preheated tundish is connected to the transport rail so that the one tundish transport truck is moved along the transport rail for transfer from the swivel rail to the pouring position. The tundish at the preheating position on the swivel table is subjected to repairs and then preheated to prepare for a next operation. In this way, that side of the swivel table which is not connected to the transport rail is adapted to serve as the preheating position. This arrangement affords easy interchange of the tundishes between the pouring position and the preheating position. As compared with the prior art arrangement employing the shift truck, the arrangement of the invention requires less floor space and only one unit of preheating device. This results in good cost saving.

DESCRIPTION OF THE PREFERRED EMBODIMENT

Figure 3:
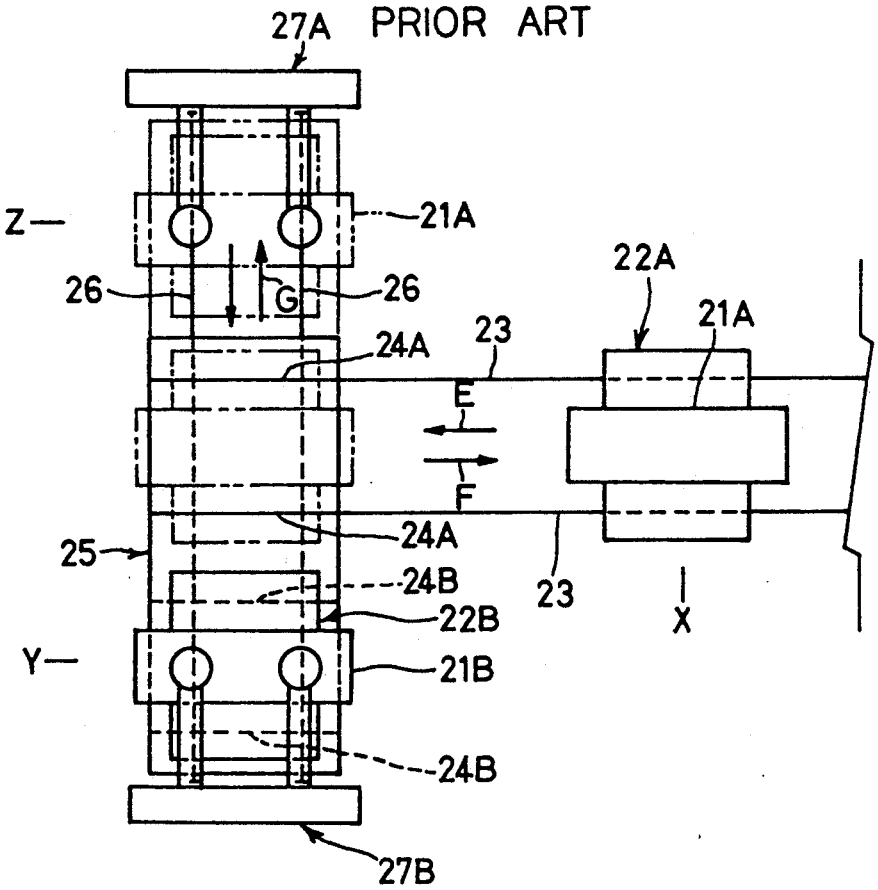
FIG.3 PRIOR ART
FIG. 3 is a schematic plan view showing a conventional tundish changing apparatus.

Before describing one embodiment of the embodiment of the invention, let us discuss the prior art arrangement in further detail with reference to FIG. 3.

As FIG. 3 shows, two tundish cars (tundish transport trucks) 22A, 22B loaded respectively with tundishes 21A, 21B are movably mounted on a transport rail 23 extending laterally from a pouring position (X). A shift truck 25 on which are laid two sets of mounting rails 24A, 24B connectable to the transport rail 23 is reciprocally movably mounted on a shift rail 26 located at the end of the transport rail 23 and extending in a direction perpendicular to the transport rail 23. At opposite locations adjacent the position at which one mounting rail 24A or 24B is connectable to the transport rail 23, there are provided preheating devices 27A, 27B which are respectively disposed at preheating positions Y, Z corresponding respectively to the tundish cars 22A, 22B on the mounting rails 24A, 24B.

One tundish car 22A loaded with one tundish 21A which has been used for a pouring operation is moved from the pouring position (X) along the transport rail 23 in the direction of arrow E, and is then mounted on a shift truck 25 through the intermediary of the mounting rail 24A. In turn, the shift truck 25 is shifted in the direction of arrow G, and the other mounting rail 24B is connected to the transport rail 23 so that the other tundish car 22B on which is mounted the other tundish 21B which has been preheated by the preheating device 27B at the preheating position (Y) is moved in the direction of arrow F until it reaches the pouring position (X). The tundish 21A transferred to the preheating position (Z) is subjected to repairs, such as lining replacement, and then preheated by the other preheating device 27A for a next use. According to such arrangement, as already stated, a large casting bed space is required for reciprocal movement of the shift truck 25 and, in addition, two heating positions (Y), (Z) and accordingly two preheating devices 27A, 27B are required.

Figure 1:
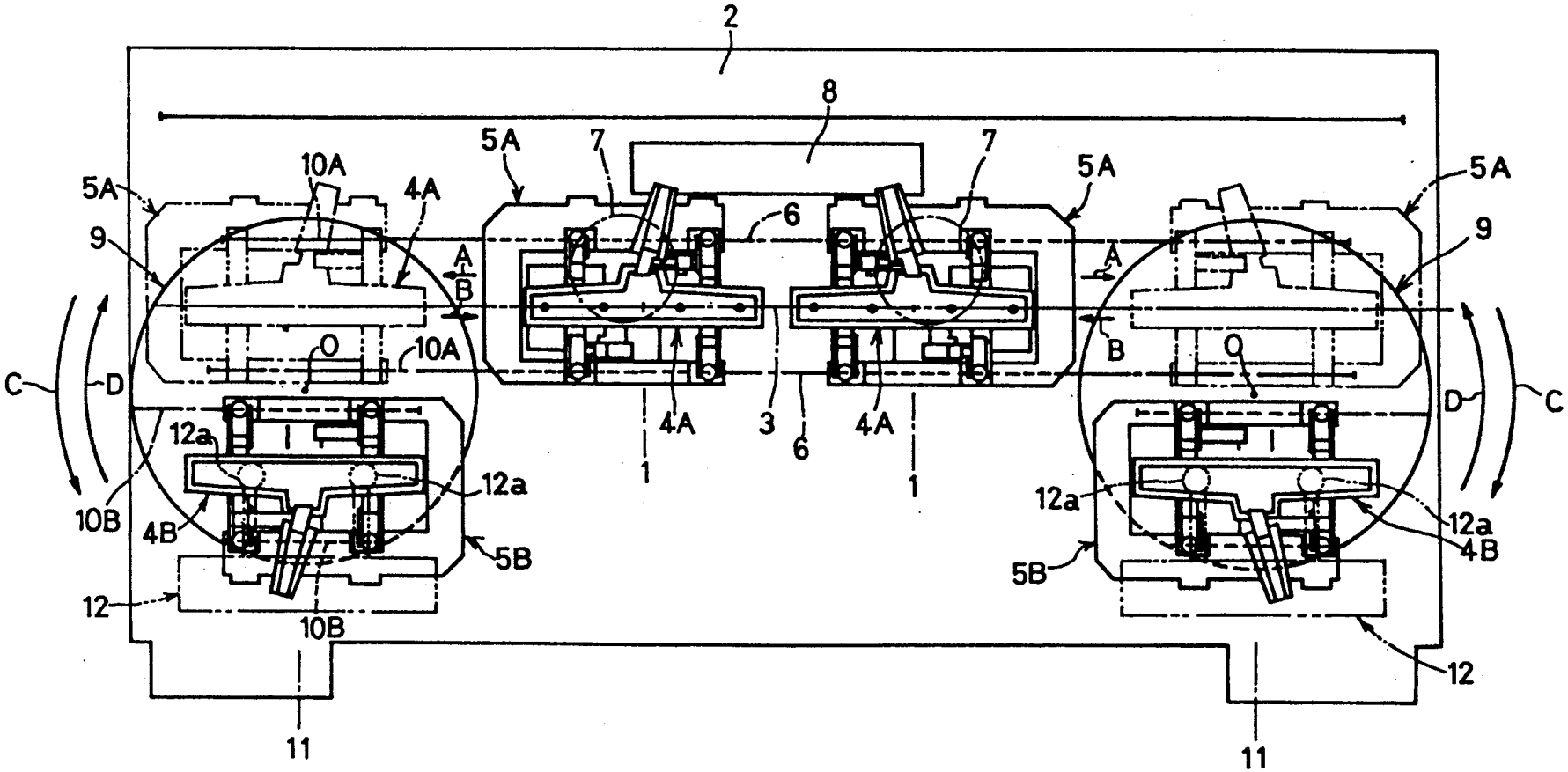
FIG. 1 is a general plan view of a tundish changing apparatus in a continuous casting installation which represents one embodiment of the invention.
Figure 2:
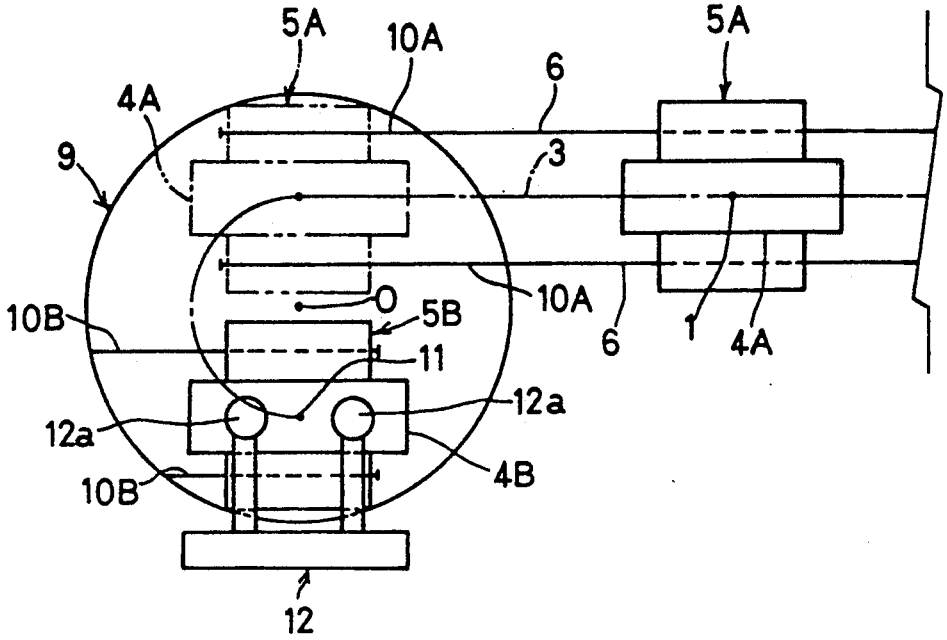
FIG. 2 is a schematic plan view showing a detail of the apparatus shown in FIG. 1.

One embodiment of the invention will now be described with reference to FIGS. 1 and 2. FIG. 1 illustrates a continuous casting installation in which a pair of tundish changing apparatuses are arranged in symmetrical positions.

Numerals 1, 1 designate pouring positions provided in closely spaced relation on a casting bed 2. A mold (not shown) of the casting machine is disposed below each pouring position 1. On the casting bed 2 there are placed a pair of transport rails 6 for guiding two tundish cars, first and second, (mobile tundish transport trucks) 5A, 5B loaded with first and second tundishes 4A, 4B which extend along a linear track 3 passing through the casting positions 1, 1. A ladle 7 is disposed above the pouring position 1, and an overflow pot 8 is disposed adjacent the pouring position 1.

Numerals 9, 9 designate circular swivel tables arranged on the casting bed 2 at opposite ends of the transport rails 6 which are capable of being loaded with two tundish cars 5A, 5B. Each swivel table 9 is both way rotatable within an angular range of 180° about a swivel axis located outward of the linear track 3. On the upper surface of each swivel table 9 which is flush with the casting bed 2 there are arranged two pairs of swivel rails 10A, 10B at positions symmetrical with respect to the swivel axis, the swivel rails 10A, 10B being connectable to the rails 6, 6.

A preheating position 11 is provided in corresponding relation to the swivel rail 10B or 10A positioned symmetrically with the swivel rail 10A or 10B connected to the travel rail 6, and a preheating device 12 is disposed above the preheating position 11. This preheating device 12 includes two burners **12*a*, for example, which can heat the interior of the tundish 4 at the preheating position 11. The burners 12*a* are so disposed that they are movable at a level above the first and second tundishes 4A, 4B, inward and outward, for the convenience of lining removal from the tundishes 4A, 4B**.

Nextly, the manner of operation for changing of the tundishes 4A, 4B from one to the other will be explained.

The first tundish 4A, mounted on the first tundish car 5A, is positioned at the pouring position 1. Molten steel is supplied from the ladle 7 into the first tundish 4A and is, in turn, poured into the mold in the continuous casting machine through a tundish nozzle. The second tundish 4B, mounted on the second tundish car 5B, is positioned in the preheating position 11. After necessary repairs, such as lining replacement, the second tundish 4B is preheated by burner **12*a* of the preheating device 12**.

Upon completion of the pouring operation by the first tundish 4A, the first tundish car 5A is moved along the transport rail 6 in the direction of arrow A, and is then mounted on the swivel table 9 through the swivel rail 10A as shown by a phantom line. The swivel table 9 is rotated 180° in the direction of arrow C for intershifting of the first and second tundish cars 4A, 4B. Then, the second tundish car 5B is moved from the swivel table 9 in the direction of arrow B along the swivel rail 10B and transport rail 6 until it reaches the pouring position 1. The first tundish car 4A conveyed to the preheating position 11 through the rotation of the swivel table 9 is subjected to repairs, such as lining replacement, and preheated for a next changing operation. At the time of next tundish changing operation, the swivel table is turned 180° in the direction of arrow D.

What is claimed is:

1. A tundish changing apparatus in a continuous casting installation including two tundish transport trucks each having a tundish mounted thereon and reciprocally movable between a pouring position and a preheating position, comprising:

a transport rail extending laterally from the pouring position for guiding said tundish transport trucks for movement thereon, a swivel table pivotally movably disposed at the end of said transport rail, a pair of swivel rails arranged on the swivel table at symmetrical positions relative to the center of swivel movement of the table and so adapted that one of said swivel rails is selectively positioned for connection to the transport rail as the table swivels, and a tundish preheating device disposed at a position corresponding to the other of said swivel rails when the one swivel rail is positioned for connection to the transport rail.

2. An apparatus as set forth in claim 1, wherein there are provided one pair each of said transport rail, said swivel table, and said tundish preheating device, and four of said tundish transport trucks.

* * * * *